US005951452A

United States Patent [19]

Stevenson

[11] Patent Number: 5,951,452

[45] Date of Patent: Sep. 14, 1999

[54] METHOD AND APPARATUS FOR THE MANUFACTURE OF INFUSION PACKAGES

[75] Inventor: John F. T. Stevenson, Rutland, United Kingdom

[73] Assignee: Tetley GB Limited, Greenford, United Kingdom

[21] Appl. No.: 08/836,509

[22] PCT Filed: Nov. 15, 1995

[86] PCT No.: PCT/GB95/02677

§ 371 Date: Jul. 31, 1997

§ 102(e) Date: Jul. 31, 1997

[87] PCT Pub. No.: WO96/15033

PCT Pub. Date: May 23, 1996

[30] Foreign Application Priority Data

Nov. 15, 1994 [GB] United Kingdom ..... 9422999

[51] Int. Cl.[6] ..... B65B 29/04

[52] U.S. Cl. ..... 493/193; 493/210; 53/134.2; 53/413

[58] Field of Search ..... 53/134.2, 193, 53/413, 450, 553; 493/210, 223, 226

[56] References Cited

U.S. PATENT DOCUMENTS

| | | | |
|---|---|---|---|
| 2,447,014 | 8/1948 | Irmscher | 53/134.2 X |
| 2,447,258 | 8/1948 | Lobley | 53/450 X |
| 2,472,440 | 6/1949 | Salfishberg | 53/134.2 X |
| 3,191,355 | 6/1965 | Morpurgo | 53/134.2 |
| 4,609,556 | 9/1986 | Goedert | 53/134.2 X |
| 4,829,742 | 5/1989 | Romagnoli | 53/134.2 |
| 5,511,359 | 4/1996 | Kenney | 53/134.2 X |

FOREIGN PATENT DOCUMENTS

| | | |
|---|---|---|
| WO 90/13487 | 11/1990 | WIPO . |
| WO 93/19997 | 10/1993 | WIPO . |

*Primary Examiner*—David A. Scherbel
*Assistant Examiner*—Anthony Ojini
*Attorney, Agent, or Firm*—Alix, Yale & Ristas, LLP

[57] ABSTRACT

Two continuous travelling webs (1, 2) of porous material are provided for forming the eventual infusion packages. The lower web (2) is dosed with measured amounts (3) of infusible substance, such as tea, on its upper surface at spaced intervals by the dosing roller (4). Two continuous travelling strips (5, 6) of tag material such as card, are also provided to form the tags in the finished infusion packages. The strips are guided to travel parallel to and at the same speed as the webs (1, 2), respectively. A rotating string drum (8) forms a continuous length of string (7) into a succession of predetermined patterns. The upper web (1) and strip (5) of tag material are guided to be side by side, and then pass in face-to-face contact with heated roller (9) which melts the thermoplastics coating on the web and strip to render them adhesive. The heated web and strip of tag material then travel for a short distance around the circumference of the string drum so that the string can adhere lightly to both the web (1) and strip (5). The web (2) carrying the dose of infusible substance, and the other strip (6) of tag material are guided to travel side by side and brought together with the web (1) and strip (5) at sealing rollers (11, 12) to form a succession of two-ply infusion containing pockets and, to correspondingly seal the strips (5, 6) of tag material. The sealed infusion-containing pockets and strips of tag material then travel together to the cutting rollers (14, 15) which cut both the strips of tag material and the webs to form infusion packages (17) and tags (18) of the desired shape.

26 Claims, 6 Drawing Sheets

FIG. 3.
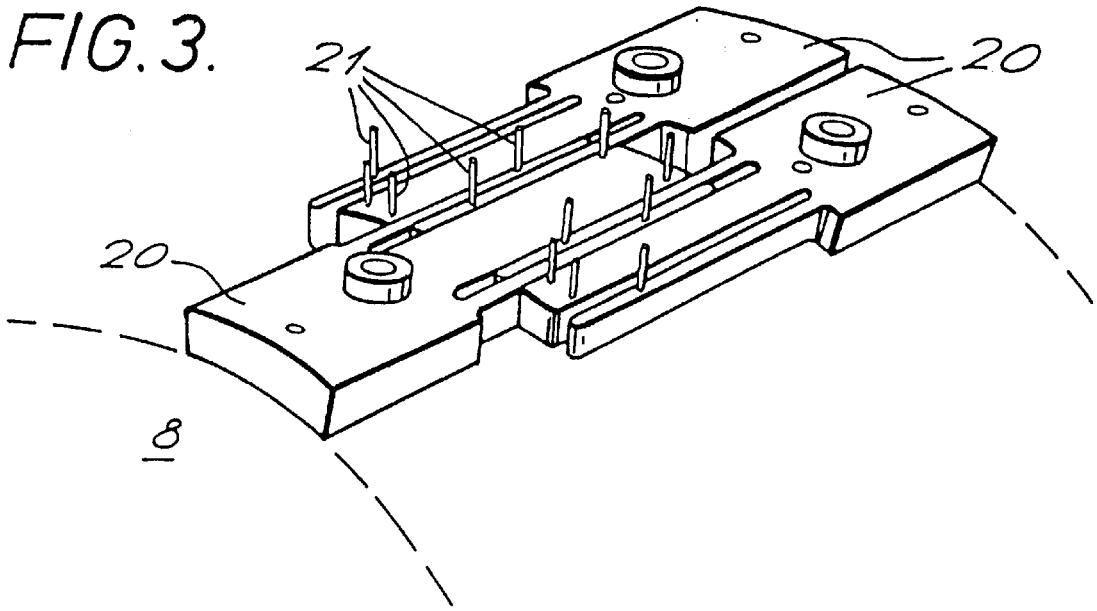
FIG. 5a.
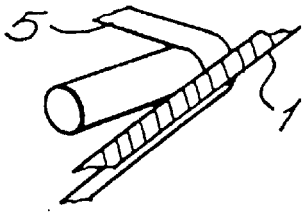
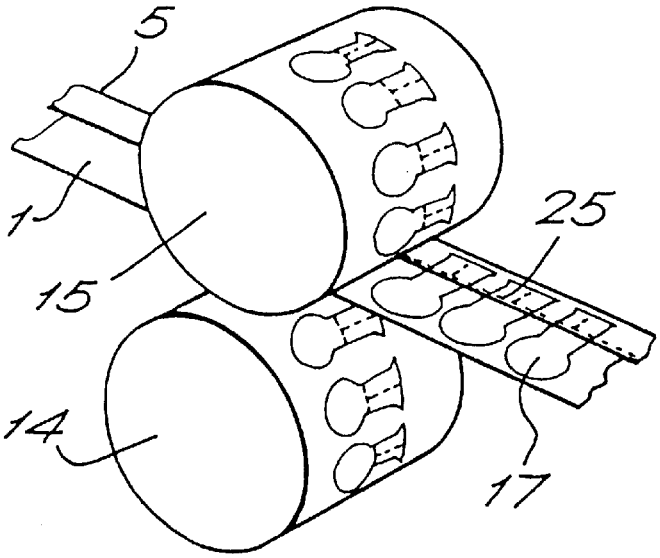
FIG. 5b.

METHOD AND APPARATUS FOR THE MANUFACTURE OF INFUSION PACKAGES

CROSS-REFERENCE TO RELATED APPLICATIONS

This is the national stage of International Application No. PCT/GB95/02677, filed Nov. 15, 1994.

The present invention relates to the manufacture of infusion packages, such as tea bags and in particular to a method and apparatus for the manufacture of tagged drawstring infusion packages having a length of slack string of the type described in WO 93/19997.

A method of manufacture for a tagged infusion package is described in WO 92/14649. In that method, a length of string between the tag and infusion package is firstly lightly adhered in a convoluted pattern to the outside surface of the continuous porous web which forms one side panel of the final infusion package. This is achieved by heating that web with a heated guide which faces one surface of the web and is effective to melt the thermoplastics coating on the web (which is also used to seal the webs together) such that the string can then be placed on and adhered to the other surface of the web which becomes the external surface of the assembled infusion package. After that, the web with the string on it is sealed to the other web on which the dose of tea, for example, has already been placed, to form a tea containing pocket which is then cut out to form a sealed infusion package. As the string is adhered to the outside surface of the infusion package, it remains in place during and after manufacture, such that loose string does not interfere with the manufacturing process or become entangled in a subsequent container, for example. The string is lightly adhered to the package (apart from its anchoring point which is firmly secured) in a tortuous pattern which can readily be released by a user without damaging the web material.

In the method of WO 92/14649, the string is adhered to the surface of the web which becomes the outside surface of the infusion package, and the heated guide for melting the thermoplastics coating on the web is arranged to face the eventual inside surface of the web. Thus in practice it is mechanically convenient for the heating and string location to take place from opposite sides of the web. However, the porous webs used to manufacture infusion packages are necessarily designed such that when heated the thermoplastics coating provides significantly greater adhesion on the inside rather than the outside surface (since the inside surfaces must be capable of being firmly heat sealed together around their outer peripheries to form the infusion packages). Thus in WO 92/14649 the string is applied to the less adhesive outer surface. The Applicants have recognised that supplying sufficient heat to the less adhesive outer surface to secure a string pattern thereon can lead to a tendency for the other, more adhesive side, of the web to adhere to its guides, which can cause it to tear, or even stop completely. The problem is exacerbated if the heating is supplied through the web from the internal side, as in the most convenient arrangement.

According to one aspect of the present invention, there is provided a method for manufacturing tagged infusion packages of the type formed from a two-ply web having an infusion containing pocket defined therein and a length of string joining the tag and package, comprising:

providing a pair of continuous travelling webs for forming successive packages;

arranging a continuous length of string in a succession of predetermined patterns, the patterns being arranged in such a manner as to provide in the final infusion package a slack length of string held within the infusion containing pocket prior to use such that pulling the tag away from the infusion containing pocket initially causes the slack length of string within the pocket to be withdrawn therefrom;

lightly adhering successive string patterns at spaced locations to the surface of one of the travelling webs which will become an inner surface of the pockets;

dosing an infusible substance on one web or between the webs;

sealing the inner surfaces of the webs together to form pockets containing the infusible substance in such a manner that, within each pocket, the string is lightly adhered in said predetermined pattern to the inner surface of one of the webs, with one portion of the string being held by means of sealed together portions of the webs, the slack length of string extending within the pocket, and a further portion of the string extending slidably through the seal at the margin of the pocket;

cutting the pockets from the sealed webs to form packages of a predetermined shape each containing within the pocket said portion of string in the predetermined pattern, the string extending outside the pocket via the margin seal; and attaching a tag to the string outside the pocket.

According to a second aspect of the present invention, there is provided an apparatus for manufacturing tagged infusion packages of the type formed from a two-ply web having an infusion containing pocket found therein and a length of string joining the tag and package, comprising:

means for providing a pair of continuous travelling webs for forming successive packages;

means for providing a continuous length of string;

means for arranging the string in a succession of predetermined patterns, the patterns being arranged in such a manner as to provide in the final infusion package a slack length of string held within the infusion containing pocket prior to use such that pulling the tag away from the infusion containing pocket initially causes the slack length of string within the pocket to be withdrawn therefrom;

means for lightly adhering the successive string patterns at spaced locations to the surface of one of the travelling webs which will become an inner surface of the pockets;

dosing means for dosing an infusible substance on one web or between the webs;

sealing means for sealing the inner surfaces of the webs together to form pockets containing the infusible substance in such a manner that within each pocket, the string is lightly adhered in said predetermined pattern to the inner surface of one of the webs, with one portion of string being held by means of the sealed together portions of the webs and a further portion of the string extending slidably through the seal at the margin of the pocket;

cutting means for cutting the pockets from the sealed webs to form packages of a predetermined shape each containing within the pocket said portion of string in the predetermined pattern, the string extending outside the pockets via the margin seal; and means for attaching a tag to the string outside the pocket.

In the method and apparatus of this aspect of the present invention, the string is lightly i.e. releasably adhered to the inside surface of the web, which is more adhesive than the outer surface. Preferably the less adhesive outer surface of the web faces (i.e. contacts) the heated surface which melts the thermoplastics coating, thereby reducing the tendency of the web to adhere to the heating surface and avoiding the potential problems we have recognised with the prior art method.

In the method and apparatus of the first aspect of the invention, a length of slack string is lightly adhered to one web within the infusion containing pocket. This enables a length of slack string to be provided whilst avoiding the slack string interfering with the manufacturing process, etc.

The method and apparatus of the first aspect of the present invention is particularly but not exclusively suited to manufacturing drawstring infusion packages of the type described in WO 93/19997, in which a slack length of string is held within the infusion containing pocket prior to use. Since the string is adhered to the inner surface of one web in the present invention, it is correctly located to be inside the infusion containing pocket after manufacture without the need for further operations.

In a preferred embodiment of the present invention therefore, the string is initially arranged in a tortuous pattern such that in the unused infusion package, a loop of string passes between two sealed together portions of the webs, with the string then extending in a convoluted fashion within the infusion containing pocket and exiting it through the sealed peripheral margin of the pocket at two spaced-apart locations. With this string arrangement, pulling on the ends of the string in a direction away from the infusion containing pocket initially causes the string to be released from the wall of the web such that the "slack" within the pocket is withdrawn therefrom, and then further pulling of the two ends of the string in opposite directions causes the package to collapse, which can express any liquid within the package.

The loop of string is preferably positioned either in or adjacent the sealed peripheral margin of the infusion containing pocket in the unused infusion package, and the ends of the string preferably exit the pocket at locations on its margin generally opposed to the location of the loop.

It is, of course, possible to have the string arranged in any other pattern, if desired.

The string can be arranged in the succession of predetermined patterns by any suitable method, such as by an oscillating lever feeding the string directly onto the web, or with a rotating wheel and rotating blocks and pin arrangement as in WO 92/14649 to form the string into a pattern before placing it directly on the web.

However, it is preferred to arrange the string in the succession of predetermined patterns by supporting the string on the periphery of a rotating drum which cooperates with the travelling web, winding the string around a plurality of pins on the surface of the drum, and moving the pins reciprocally along the surface of the drum in a direction which is parallel to the axis of the drum as the drum rotates to shape the string patterns. In this manner, the string can be formed into the desired pattern on the drum surface, and then placed in contact with the inner surface of one web (whose outer surface is heated) which is arranged to cooperate with the rotating drum to adhere lightly the string in the succession of predetermined patterns to the web inner surface. The process is preferably continuous, with successive patterns for location in successive pockets being formed continuously from a single length of string. It can be easier to control a single continuous length of string during the manufacturing process than a plurality of shorter lengths of string.

The preferred method of forming the succession of string patterns is particularly applicable to the preferred string pattern of the present invention. An oscillating lever is unsuitable for that pattern because the forces on the lever necessary to achieve the pattern would be too great. The use of rotating pins on a drum is also unsuitable, since rotation causes relative movement in all directions in the string pattern, and is thus less precise, such that ensuring that the string is in a given position relative to the web (e.g. the sealed margin) is very difficult. Furthermore, it is very difficult to provide a string with two free ends exiting on substantially the same side of the infusion containing pocket using rotating pins.

It is believed that the preferred string patterning arrangement would be applicable generally to tagged infusion packages including a string formed into a predetermined pattern, and thus according to a third aspect of the present invention, there is provided an apparatus for manufacturing tagged infusion packages of the type formed from a two-ply web having an infusion containing pocket defined therein and a length of string joining the tag and package, comprising means for providing a pair of continuous travelling webs for forming successive packages;

means for providing a continuous length of string;

means for arranging the string in a continuous succession of predetermined patterns, said means including a drum rotatable to cooperate with one of the travelling webs and having a plurality of pins on its surface reciprocally movable in a direction which is parallel to the axis of rotation of the drum for engaging the string and shaping the string into the successive patterns;

means for lightly adhering the continuous successive string patterns at spaced locations to said cooperating web;

dosing means for placing doses of infusible substance on one of the webs or between the webs;

sealing means for sealing the webs together to form pockets containing the infusible substance;

cutting means for cutting the pockets from the sealed webs to form packages each having a portion of string lightly adhered thereto in the predetermined pattern; and means for attaching a tag to a portion of the string.

According to a fourth aspect of the present invention, there is provided a method for manufacturing tagged infusion packages of the type formed from a two-ply web having an infusion containing pocket defined therein and a length of string joining the tag and package, comprising:

providing a pair of continuous travelling webs for forming successive packages and a continuous length of string;

arranging the string in a continuous succession of predetermined patterns by supporting the string on the periphery of a rotating drum having a plurality of pins on its surface which cooperates with one of the travelling webs, engaging the string on the pins, and moving the pins reciprocally in a direction which is parallel to the axis of rotation of the drum as the drum rotates to shape the string into the successive patterns;

lightly adhering the continuous successive string patterns at spaced locations to said cooperating web;

placing an infusible substance on one web or between the webs;

sealing the webs together to form pockets containing the infusible substance;

cutting the pockets from the joined webs to form packages each having a portion of string lightly adhered thereto; and attaching a tag to a portion of the string.

The drum is preferably arranged such that as it rotates the pins move under a camming action to move the string gradually into the predetermined patterns.

In all of the above aspects the string may conveniently be lightly i.e. releasably adhered to the inner surface of one of the travelling webs by heating the web using a heated roller adjacent its outer surface, for example, to melt the thermoplastics coating and substantially simultaneously or subsequently bringing the string into contact with the now adhesive inner surface of the web.

In the preferred arrangement using the rotating drum, the web is preferably heated and then brought into contact with the surface of the drum bearing the patterned string, such that the drum (and thus string) and web move synchronously with the string in contact with the web for a portion of the drum's circumference. Preferably a relatively long period of contact is maintained to ensure that the string adheres adequately to the web.

It is important that the pins do not pierce the web when it is contacting the string. Thus the tops of the pins should be arranged to be level with or below the diameter of the string during the adhering phase. Preferably, therefore, the pins are arranged to retract into the drum at the time when the string pattern is transferred to the web. This is preferably achieved by arranging the pins to ride in holes in the drum with a cam surface holding them above the drum surface during the part of the drum's rotation when the pins catch the string, and providing a recess in the cam supporting the pins at the appropriate point for the pins to descend into. An external cam can then be used to force the pins down into their holes (i.e. the recess) to the level of the string or below.

The string is preferably adhered to the web which is not dosed with infusion, as the string can interfere with the dosing process. Most preferably, the infusible substance is dosed onto a horizontally travelling bottom web and the string placed on a further web arranged above the bottom web. However, other arrangements are possible.

The two travelling webs can be brought together and sealed to form the infusion containing pockets by any suitable means, such as heated crimping rollers. In the case where a loop of string is to be held either in or adjacent the margin between sealed together portions of the webs, the crimping (i.e. sealing) means is preferably relieved at the position of the string to provide an unsealed groove for the string. This helps to prevent the presence of the string adversely affecting the sealing and the string from being damaged by the crimping means. The sealing where the string exits the pocket can also be relieved, if desired. This is desirable in a slidable drawstring arrangement.

The sealed webs can be cut into packages of the desired shape by any suitable means, such as a rotating cutters or knife assembly. Preferably, the travelling sealed web is passed between co-rotating cutting rollers such as those described in WO 90/13487. The cut to form the package should be around the sealed margin of the infusion containing pocket. At the point where the string exits the pocket, a skip-cut can be made to avoid severing the string. However, the string is preferably arranged to exit via a pre-cut edge of the web, such that no further cut is required along that edge at the cutting stage. The cutting means can then be appropriately relieved along that edge. This ensures that there is no risk of severing the string exiting the infusion containing pocket. In the case of manufacturing round infusion packages, the packages are therefore preferably cut to be round except along a flattened edge via which the string exits the package, i.e. to have a "purse-shape".

As the sealing and cutting stages must be synchronous to ensure that the infusion packages are cut along the sealed regions, it is important for the rotating crimping rollers and rotating cutters or knife assembly to be accurately synchronised with one another.

The tag can be attached to the string outside the infusion containing pockets by any suitable method, such as cutting a tag out, lightly adhering the tag to the string and then folding it over to attach it firmly.

However, in a particularly preferred embodiment of the present invention, the tag is formed from two continuous travelling strips of tag material, which strips are guided to travel parallel to, at the same speed as, and adjacent the webs during the sealing and cutting steps and which are sealed together and cut out simultaneously with the infusion packages. The string is preferably lightly adhered to one of the strips, the strips sealed together to trap the string, and then the tags cut from the sealed strips.

To attach the string, one of the strips of tag material can be guided to travel side by side with the web whilst the string pattern is laid thereon so that the string pattern is lightly adhered to both the web and the strip of tag material, with the string bridging the gap between the two. This can be achieved by passing the tag material and web simultaneously past the heated roller and into contact with the surface of the string drum.

To form the completed tag, the strips of tag material are preferably brought into face to face contact next to the webs upstream of the sealing stage, such that both the webs and the two strips of tag material can then be sealed to each other simultaneously. The two-ply web and tag strip extending parallel to one another are then fed together to the cutting stage. The tags can then be cut out by the same rotating cutters or knife assembly as for the infusion packages. It is preferably at this stage that the string is severed between successive tags, and until this final cut, the string remains continuous.

In the preferred string pattern of the present invention, the tag is preferably perforated or indented by using, e.g. a skip cut, across its width in a region between the two portions of the string exiting the infusion containing pocket, such that once the package is cut out, the tag can easily be separated into two pieces, each anchoring one end of the string, ready for pulling the ends of the string apart.

The strips of tag material are preferably spaced laterally from the edge of the webs by the desired final spacing of the tag from the infusion package. This arrangement means that the string exits both the tag and webs along free edges thereof, thus avoiding the need to skip-cut in the region of the string to avoid the risk of severing the string bridging the web and tag. Alternatively one or both webs and strips of tag material can be arranged to overlap slightly, such that the sealing of the tag strips traps the web or webs therebetween and thus fixes the tag to the package. This helps to avoid tags pulling free of the package prior to use. In the latter case, it is necessary to skip cut along a line between the tag and web to form a line of weakness for separating them in use. A skip-cut must also be used at the position of the string to avoid severing it.

The tags may be cut such that substantially all of the tag material is used in the tags. This can be achieved in the case of rectilinearly shaped infusion packages by cutting the tags to be the same length as the infusion packages. This leaves no discrete waste portions which must be collected from the tag material. If the tags are cut to be smaller, or of a nonrectilinear shape, such that some waste tag material results, then preferably the tags are cut such that the waste forms a continuous strip as this makes its removal easier.

The tags are preferably cut in a shape that mirrors the shape of the infusion package. This allows the tag to match the shape of the perimeter of the infusion package when folded to overlie the infusion package. This preferred arrangement is applicable to tags manufactured and attached to the infusion package by any means and not just tags formed from a travelling continuous strip of tag material. This feature is particularly applicable to the manufacture of "round" infusion packages in accordance with the present invention. In that case, as discussed previously, it is preferred for the infusion packages to be round except along the edge along which the string exits the infusion containing pocket. By having a tag which matches the "purse-shaped" profile of the package when folded over it, the tag can disguise the fact that the package itself is not perfectly round. Thus, the aesthetic appeal of a round infusion package can be retained, with the manufacturing convenience of the string exiting along a flat, pre-cut edge of the webs.

The preferred method and apparatus for attaching the tags to the string of the present invention is particularly efficient and mechanically simple. It is effectively a constant speed machine (the only discontinuous process is the dosing of the infusible substance). Thus, it does not require, for example, the discontinuous operation of cutting tag pieces and folding them. The number of moving parts is therefore reduced, reducing maintenance needs, cost and potential errors. Furthermore, as both tag material and webs move at constant speed as continuous strips, the waste remaining after the tags and packages are cut out may be provided in a continuous, constant velocity strip. This means that it can be easily removed as a continuous piece of waste web and tag material using an appropriate vacuum. This is particularly efficient and mechanically simple.

According to a fifth aspect of the present invention, there is provided a method for manufacturing tagged infusion packages of the type formed from a two-ply web having an infusion containing pocket defined therein and having a length of string joining the tag and package, comprising:

providing a pair of continuous travelling webs for forming successive packages, each web having associated therewith a continuous strip of tag material for forming the tags, the strips being guided to travel parallel to and at the same speed as the respective webs;

adhering a length of string to one web and its associated strip of tag material whilst the web and strip travel side by side, such that the string bridges the web and tag material;

dosing an infusible substance on one of the webs or between the webs;

sealing the webs and strips of tag material together to form a two-ply web having pockets containing the infusible substance and a two-ply tag strip travelling to one side of the two-ply web, the string extending between the web and tag strip at spaced locations;

cutting the pockets and tags from the sealed webs and strips of tag material to form tagged infusion packages.

According to a sixth aspect of the present invention, there is provided an apparatus for manufacturing tagged infusion packages of the type formed from a two-ply web having an infusion containing pocket defined therein and having a length of string joining the tag and package, comprising:

means for providing a pair of continuous travelling webs for forming successive packages, and for providing associated with each web a continuous strip of tag material for forming the tags guided to travel parallel to and at the same speed as the respective webs;

means for adhering a length of string to one web and its associated strip of tag material, whilst the web and strip travel side by side, such that the string bridges the web and tag material;

dosing means for placing a dose of infusible substance on one of the webs or between the webs;

sealing means for sealing the webs and strips of tag material together to form a two-ply web having pockets containing the infusible substance and a two-ply tag strip travelling to one side of the two-ply web, the string extending between the web and tag strip at spaced locations; and cutting means for cutting the pockets and tags from the sealed webs and strips of tag material to form tagged infusion packages.

The present invention also extends to infusion packages formed by any of the aspects of the present invention described above.

It will, of course, be apparent to the skilled person that in all aspects of the present invention the two-ply web and pairs of continuous travelling webs can be provided, as is well-known in the art, by a single sheet of web material which is folded over to form the infusion containing pockets. This applies equally to the two strips of tag material used in some aspects of the invention. Again, a single piece of tag material can instead be folded over to form the tags.

The present invention is applicable to all forms of infusion package, and is particularly suited to the manufacture of tea and coffee bags.

A number of preferred embodiments of the present invention will now be described by way of example only and with reference to the accompanying drawings, in which:

FIG. 3 shows the string carriers which are on the string drum of the present invention;

Figure 6A:
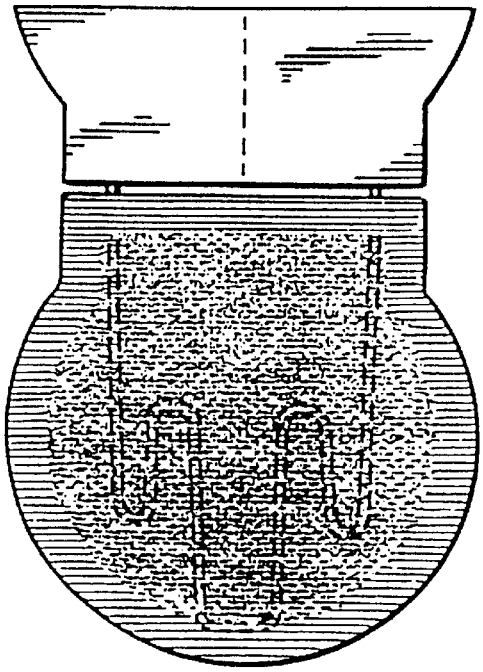
Figure 6B:
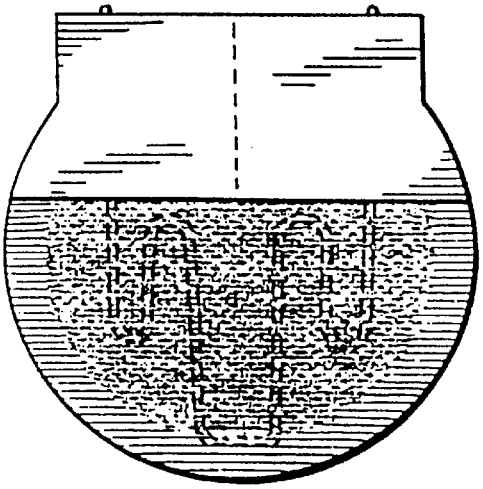
Figure 7:
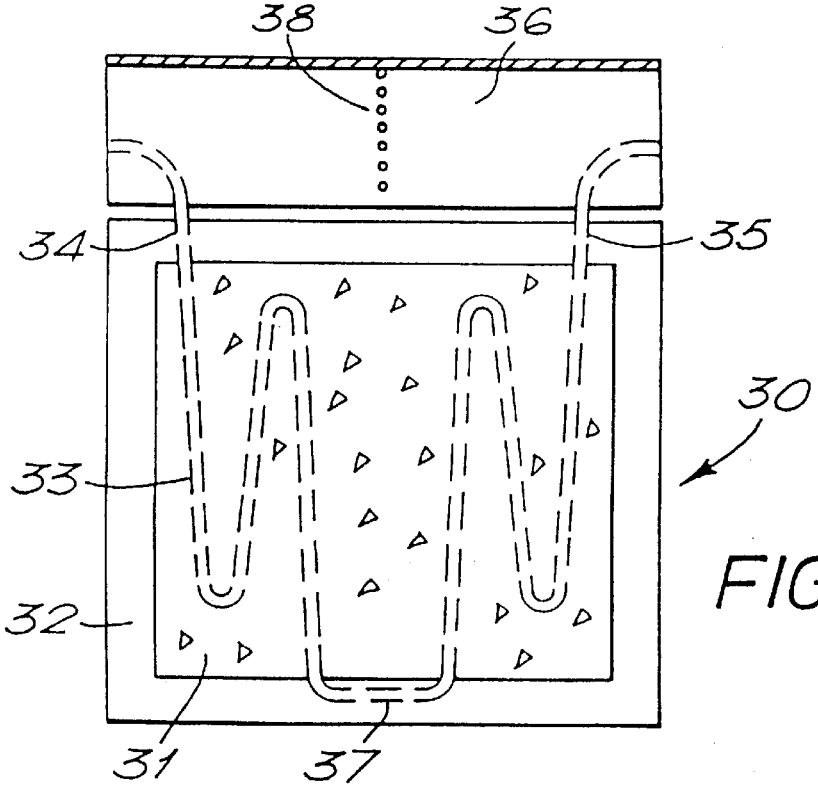
Figure 8:
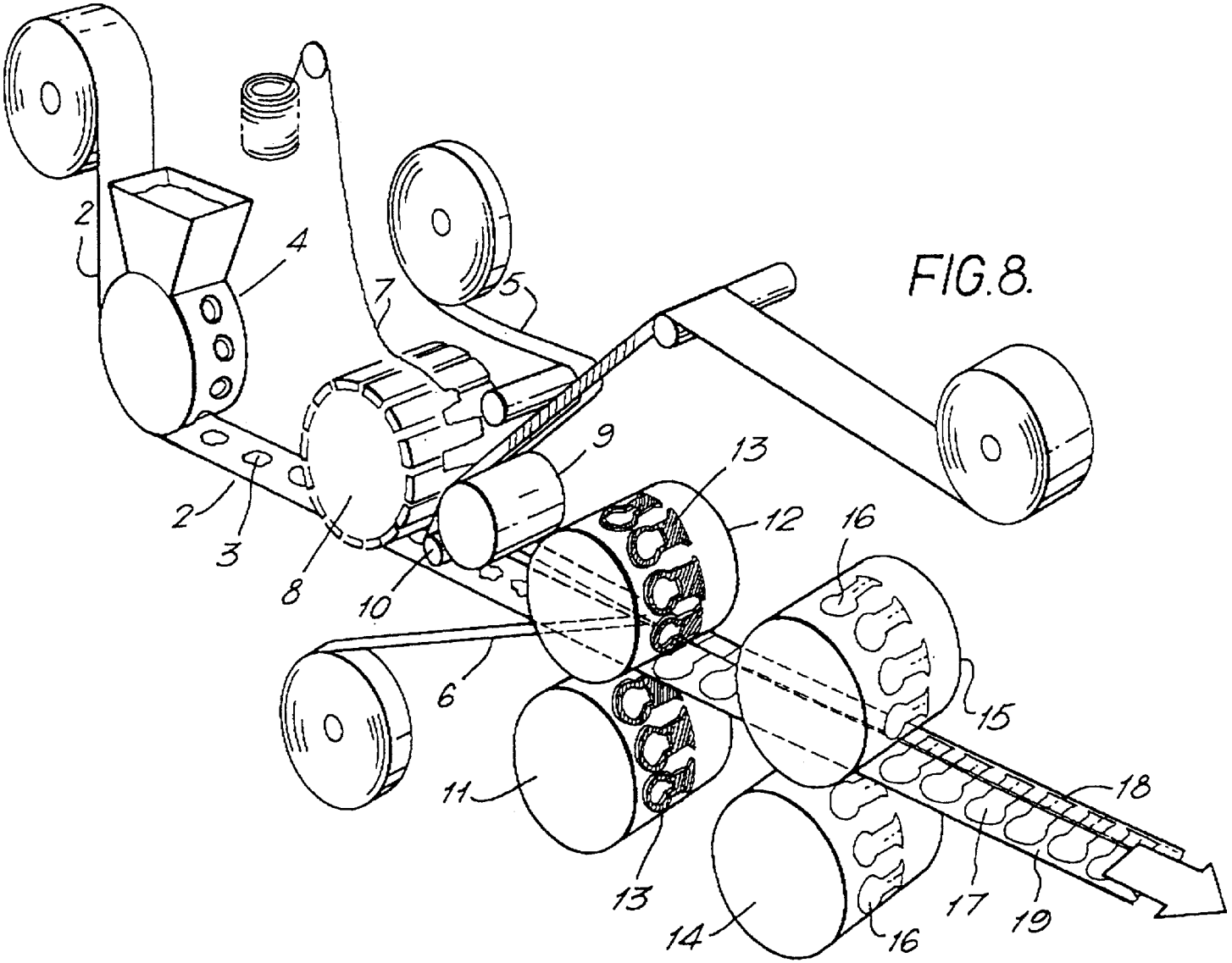

FIGS. 5*a* and 5*b* show the upper web and tag strip arrangement and cutting rollers, respectively, for an alternative embodiment of the present invention;

FIGS. 6*a* and 6*b* show an infusion package manufactured in accordance with the preferred embodiment of the present invention;

FIG. 7 shows an alternative infusion package manufactured by the method and apparatus of the present invention; and FIG. 8 shows schematically the apparatus of the present invention.

Figure 1:
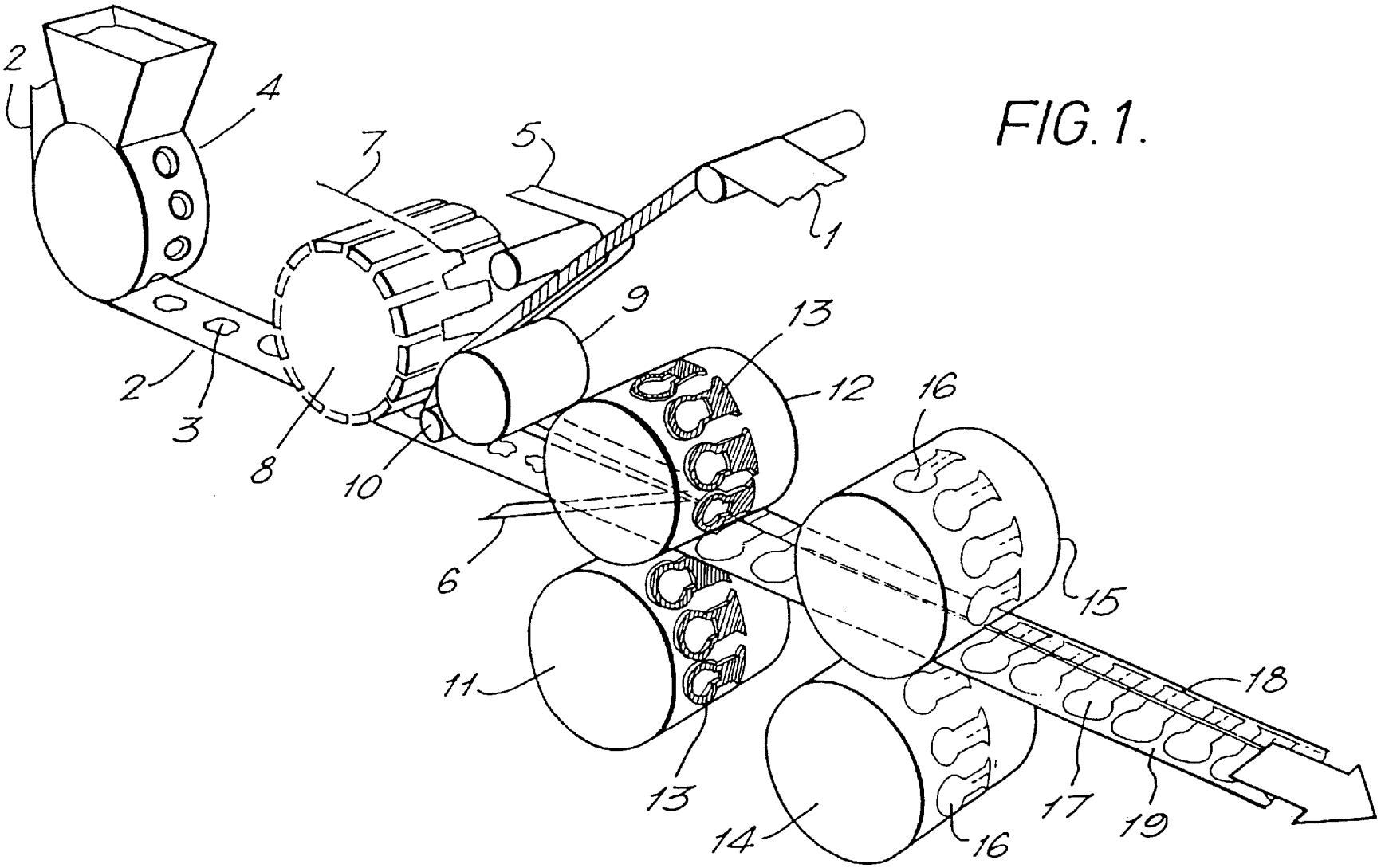
FIG. 1 shows schematically the apparatus of the present invention.

FIG. 1 shows one embodiment of the present invention.

Two continuous travelling webs 1, 2 of porous material are provided for forming the eventual infusion packages. The webs can be any suitable material for forming infusion packages and are coated with an appropriate thermoplastic coating to render them adhesive.

The lower web 2 is dosed with measured amounts 3 of infusible substance, such as tea, on its upper surface at spaced intervals by the dosing roller 4, which can be any such roller known in the art. The web 2 is supported on conveyors (not shown) for its whole length.

Two continuous travelling strips 5,6 of tag material such as card, are also provided to form the tags in the finished infusion packages. The strips are guided to travel parallel to and at the same speed as the webs 1, 2, respectively. It is envisaged that they also have a hot-melt adhesive coating for adhesive purposes. The strips 5, 6 are laterally spaced from the webs 1, 2 at the desired distance of the final spacing of the tags from the webs in the finished packages.

A rotating string drum 8 forms a continuous length of string 7 into a succession of predetermined patterns. The drum 8 carries a number of separately moving pins which move in a direction parallel to the axis of rotation of the drum 8 to shape the string patterns. The string 7 is caught by the pins, and their subsequent movement as the drum 8 rotates forms the patterns. This will be described in more detail below, with reference to FIGS. 3 and 4.

Figure 2:
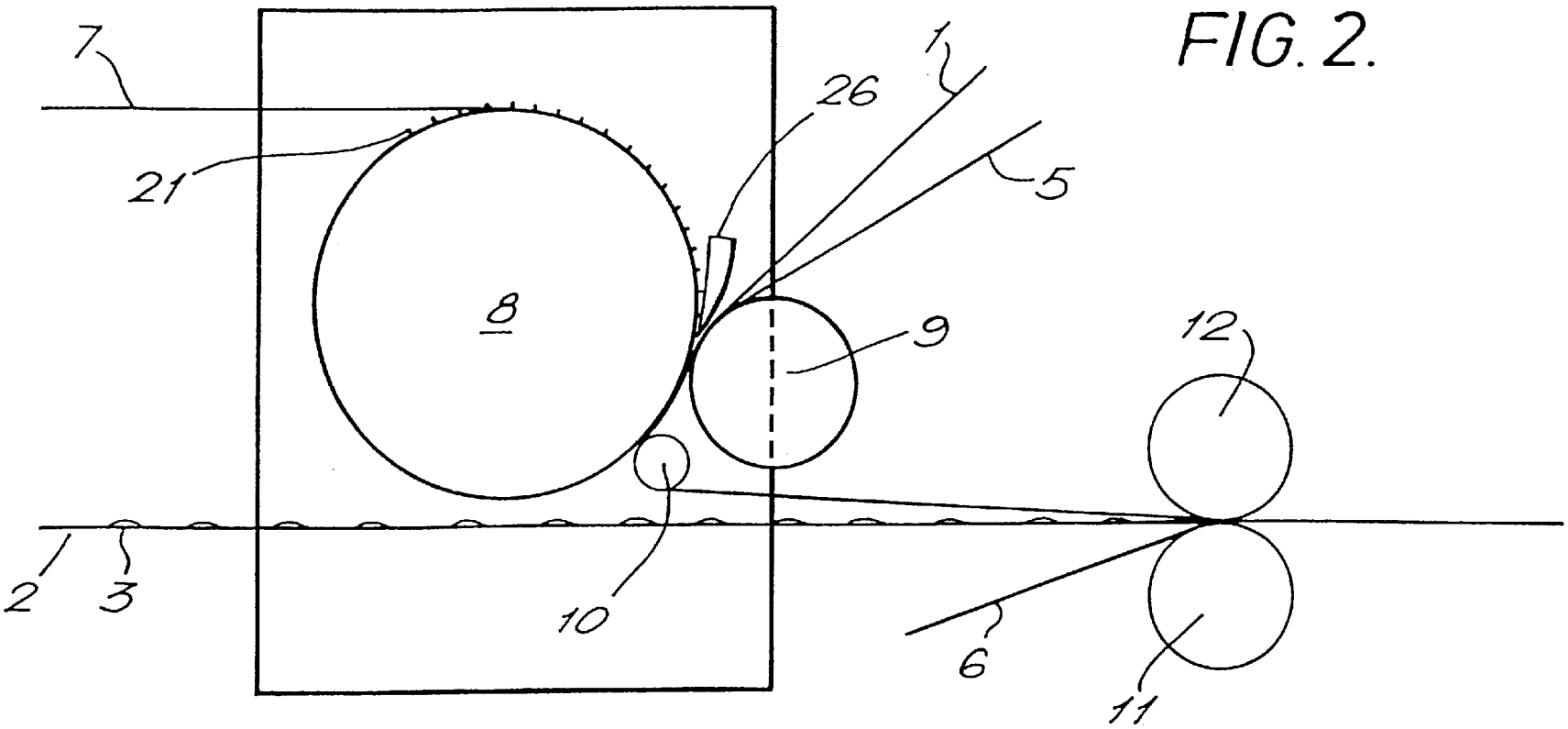
FIG. 2 shows a side view of the string drum and sealing rollers of the present invention.

To manufacture an infusion package, the upper web 1 and strip 5 of tag material are guided to be side by side, and then pass in face-to-face contact with heated roller 9 which melts the thermoplastics coating on the web and strip to render them adhesive. The heated web and strip of tag material then travel for a short distance around the circumference of the string drum 8 held in face-to-face contact with it (i.e. with the string 7) (see also FIG. 2) by the roller 10, so that the string can adhere lightly to both the web 1 and strip 5 in a succession of the predetermined patterns, with the string bridging the web 1 and strip 5. A distance of 20–30 cm in contact depending on the web velocity is suitable to ensure adequate adhesion.

The web 2 carrying the dose of infusible substance, and the other strip 6 of tag material are guided to travel side by side and brought together with the web 1 and strip 5 carrying and bridged by the string at sealing rollers 11, 12. Those rollers are heated and have preformed crimping patterns 13 for sealing the webs 1, 2 to form together a succession of two-ply infusion containing pockets, and to correspondingly seal the strips 5, 6 of tag material together.

The webs 1, 2 and strips 5, 6 of tag material pass between the sealing rollers 11, 12 which are arranged to seal the webs 1, 2, together to form a succession of two-ply infusion containing pockets having sealed peripheral margins, in such a manner that the pockets also contain the string 7 in the predetermined pattern lightly adhered to the inner surface of the web 1, with a loop of the string being held in one margin by sealed together portions of the webs and the ends of the string slidably exiting the sealed margins of the pockets at spaced locations opposite the loop of string through the side of the pocket parallel to the strip of tag material. The string ends then pass between the strips of tag material, which are sealed together and thus anchor the string.

The sealing rollers are arranged such that a loop of the string formed in the predetermined pattern is looped between two sealed together portions of the margin of infusion containing pocket. The sealing rollers 11, 12 may be relieved at that point to provide a groove for the string to rest in. The rollers 11, 12 may also be relieved at the points where the string exits the margins of the pockets.

It should be noted that at this stage the string still extends continuously between adjacent packages along the strip of tag material.

The sealed infusion-containing pockets and strips of tag material then travel together supported on a conveyor (not shown) to the cutting rollers 14, 15. The cutting rollers are provided with co-rotating cutters with preformed cutting shapes 16 which cut both the strips of tag material and the webs to form infusion packages 17 and tags 18 of the desired shape. The cutting rollers also sever the string bridging adjacent tags (i.e. packages) when they cut out the tags. The cutting rollers are preferably of the type described in WO 90/13487. Alternative cutting means can be used, if desired.

The cutting rollers 14, 15 are arranged to cut the infusion packages around the seals formed by the sealing rollers 11, 12. Thus it is essential that the operation of the cutting and sealing rollers is synchronised. To ensure this, the sealing rollers 11, 12 and the cutting rollers 14, 15 are mechanically locked to rotate together. The sealed tag strips are arranged to travel over a number of rollers (not shown) on the conveyor (not shown) supporting the tag strip and sealed web between the sealing and cutting rollers. These rollers are arranged to raise the strip of the tag material relative to the web and return it to the level of the web, such that the tag strip travels a relatively longer distance than the web between the sealing and cutting rollers. This takes up the slack in the tag strip relative to the web caused by the sealing of the web, thus ensuring that the operation of the cutting and sealing rollers is synchronised with respect to both the sealed tag strip and sealed web. Weighted rollers (not shown) may also be provided to act on the upper surface of the sealed web and strip of tag material to ensure that they do not move adversely between the sealing and cutting stages.

It should be noted that as the edge of the infusion containing pocket adjacent the tag is formed by the free edge of the webs, there is no need to provide a cut along that edge to form the infusion containing package. Thus the string bridging the sealed web and tag strip is not severed.

In an alternative embodiment shown in FIGS. 5*a* and 5*b*, the web and the tag material can be arranged to overlap, as shown in FIG. 5*a* for the upper web 1 and tag material strip 5, such that when sealed together the upper web 1 is trapped within the tag. In that case, it is necessary to perform a skip-cut 25 along the edge between the web and tag material, so that they can be separated for use (FIG. 5*b*). It is also essential to ensure that skip cut does not cut the string bridging the web and tag material.

The tags can be formed with a perforated line of weakness down their centre, by means of a skip cut provided by the cutting rollers 14 and 15, so that in use the tag can easily be torn apart to allow the ends of the string to be pulled apart.

After the cutting stage, the cut infusion packages 17 and tags travel together with the remaining web along a conveyor (not shown). The waste material 19 is a continuous strip, and is drawn off by a suitable vacuum means (not shown).

It should be noted that in this preferred embodiment the tags are cut to be equal to the width of the infusion package and are shaped to match the profile of the infusion package when folded to overlie it. This is shown in FIGS. 6*a* and 6*b*, which show an infusion package which has been manufactured using the preferred apparatus of the present invention as it appears when first cut out (FIG. 6*a*), and with the tag 18 folded to overlie the package 17 (FIG. 6*b*). In view of the shape of the tag, there is some waste tag material in this arrangement. The tags are therefore cut to be narrower than the full width of the strip of tag material, so that a continuous strip of tag material (extending along the edge facing away from the infusion packages) is left as waste. This continuous strip of waste tag material is drawn off by a vacuum. It should be noted that in the case of rectilinear tags, the tags could be cut such that there is no waste tag material at all.

The cutout infusion packages 17 are carried on a vacuum conveyor (not shown) for packaging. The tags can be flipped over before packaging to lie on top of the infusion package by appropriate means, if desired.

Although the above embodiment of the present invention has been described as using two separate webs of web material to form the infusion packages, the infusion packages can equally be formed, as is well know to the person skilled in the art, from a single piece of web material which is then folded in half to form the infusion packages. This can be achieved by any known suitable technique. In one such arrangement the string and infusible substance could be placed side by side on the single sheet of web material (for example, by arranging the dosing roller and string drum side by side) and the web material then folded over and sealed to form the infusion containing pockets. Alternatively, the string could be placed firstly on the web and then the infusible substance dosed on top of it, before folding and sealing the web. The strips of tag material can equally be provided in the form of a single strip of tag material which is folded over and sealed to form the tags.

Figure 4:
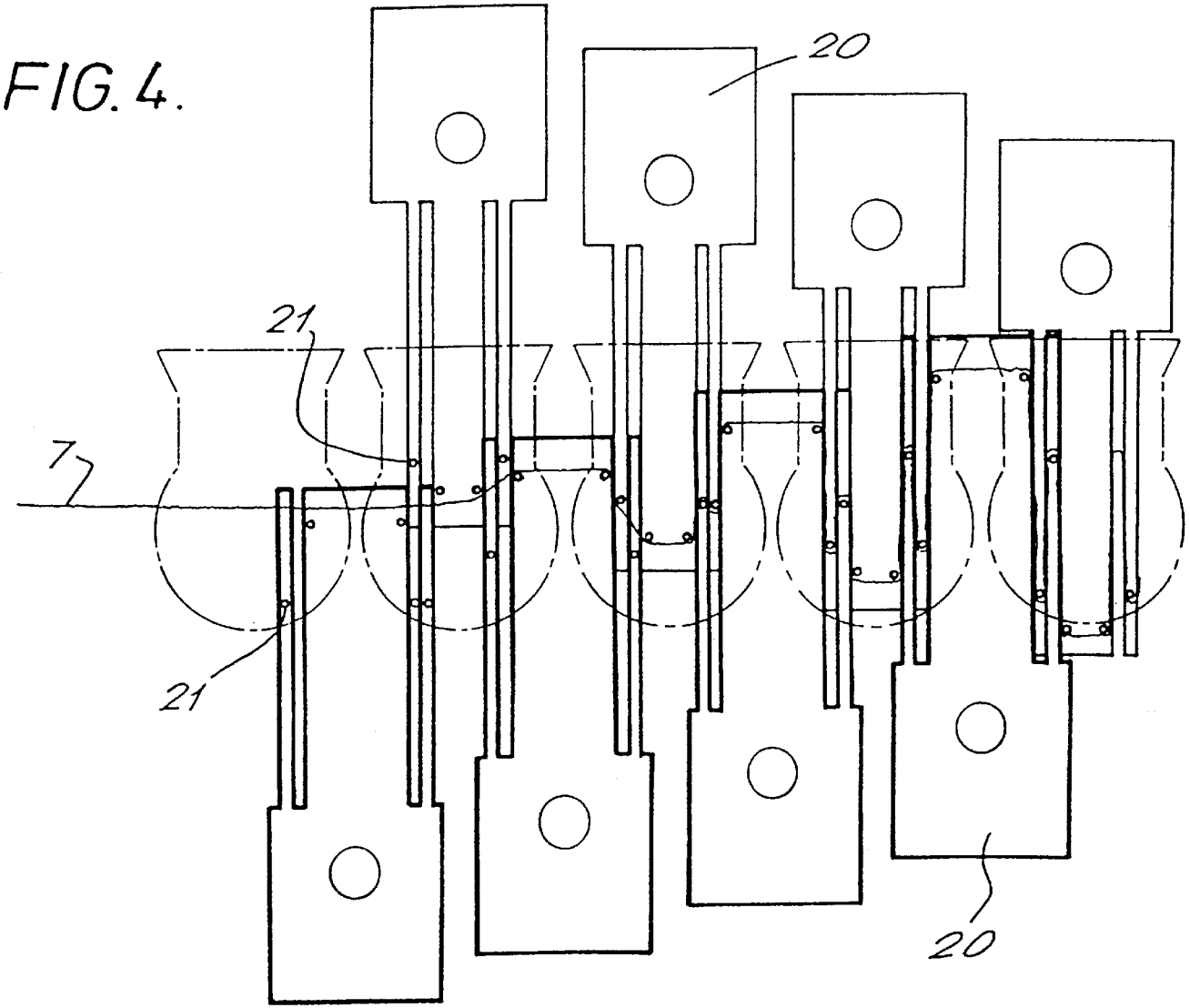
FIG. 4 shows the progressive stages of movement of the string carriers to form the succession of predetermined string pattern of the present invention.

The arrangement of the string in its preferred predetermined pattern and its attachment to the web 1 will now be described in more detail with reference to FIGS. 3 and 4 of the drawings.

FIG. 3 shows three carriers 20 which are mounted on the surface of the string drum 8 (shown in broken outline). The carriers 20 each support a number of pins 21 which are designed to snag and then move the string into the desired shape. The carriers 20 are mounted so as to rotate with the drum 8 as it rotates, and are also arranged to move reciprocally in a direction parallel to the axis of rotation of the drum as the drum rotates, thereby to move the pins to shape the string into a succession of the desired predetermined pattern. The reciprocal movement of the carriers 20 is performed, for example by means of cams (not shown) above the surface of the drum in which rods protruding from the carriers 20 run and are moved as the drum 8 rotates.

The pins 21 rest in holes in the carriers 20. They are held at a position protruding from the carriers 20 by a cam surface (not shown) below the carriers. Alternatively, they could, if desired, be spring-loaded to hold them above the surface of the carriers 20, although this is not preferred due to the relatively small size of the pins and thus the difficulty in arranging spring-loading.

In use, the string is introduced horizontally across the surface of the string wheel 8 and is then caught by the pins 21 as the carriers 20 move parallel to the axis of rotation of the drum 8. FIG. 4 shows schematically the movement of the carriers 20 as the string drum 8 rotates to form the desired string patterns. The eventual shape of the cutout infusion packages and tags is shown superimposed to illustrate how the string eventually lies. It can be seen that the string 7 enters between the pins on two adjacent carriers, which carriers then move axially towards one another such that the pins 21 form the loops of string into the correct pattern.

Once the successive string patterns have been formed, they are lightly adhered to the web and tag material by contacting the heated web and tag material with the string, as described previously. This light adhesion is such that the string can be readily released from the web and strip of tag material by a user without damaging the web or tag material.

The carriers 20 return to their original positions once the string 7 has been lifted off them and adhered to the web and strip of tag material as the drum rotates, before catching the string again.

A supporting cam surface (not shown) for the pins 21 lies on the drum 8 below the carriers 20 and causes the pins to protrude above the surface of the carriers 20 to catch the string. The cam surface has a recess at the stage when the string drum is becoming adjacent the web (i.e. at the location where the string is to be transferred to the web) to allow the pins 21 to descend to the level of or below the string at this point.

If the tops of the pins themselves were to come into contact with the web, then they could pierce web. The pins are therefore pressed down into the recess by means of an external cam 26 (FIG. 2) which acts on their tops as the drum 8 rotates towards the heated roller 9. This external cam ensures that the pins have descended to the level of the string or below by the time the string comes into contact with the web.

FIG. 7 shows an alternative, rectilinearly shaped infusion package prepared in accordance with the present invention. It is of the type described in WO 93/19997. It should be noted that with a tag and package of this shape, the tag can be cut from a continuous strip such that there is no waste tag material.

The infusion package 30 has an infusion containing pocket 31 surrounded by a sealed margin 32.

A drawstring 33 enters the margin at a point 34, extends across the pocket 31 in a convoluted fashion, passes as a loop 37 through the margin 32 opposite the entry point 34 and again crosses the pocket 31 in a convoluted fashion to exit at point 35. The loop of string 37 is held between two sealed together portions of the margin, and at the exit points 34 and 35 the string slidably exits the infusion containing pocket 31 through the margin. Each end of the string is then anchored in the tag 36. The string within the infusion containing pocket 31 is lightly adhered to one of the webs, such that it can be easily released therefrom by a user without damaging the webs by pulling on the ends of the string.

In use, the tag 36 is pulled away from the infusion containing package 30 to release the string from the web to remove the slack string within the pocket 31 such that the package may then be infused. After infusion, the tag 36 can be torn along perforated line 38 and the two pieces of tag then pulled in opposite directions thereby pulling the ends of the string 33 in opposite directions, which by virtue of the loop retained within the sealed margin 32 causes the infusion package to collapse, thereby expressing liquid therefrom.

The method and apparatus of the present invention is applicable to all types of infusion packages, and in particular tea and coffee bags. It can be used to make packages of any shape, such as round or rectangular.

I claim:

1. A method for manufacturing tagged infusion packages of the type formed from a two-ply web having an infusion containing pocket defined therein and having a length of string joining the tag and package, comprising:

providing a pair of continuous travelling webs for forming successive packages, each web having associated therewith a continuous strip of tag material for forming the tags, guiding the strips to travel parallel to and at the same speed as the respective webs;

adhering a length of string to one web and its associated strip of tag material whilst the web and strip travel side by side, such that the string bridges the web and tag material;

dosing an infusible substance at a location adjacent one of the webs;

sealing the webs and strips of tag material together to form a two-ply web having pockets containing the infusible substance and a two-ply tag strip travelling to one side of the two-ply web, the string extending between the web and tag strip at spaced locations;

cutting the pockets and tags from the sealed webs and strips of tag material to form tagged infusion packages.

2. A method as claimed in claim 1, further comprising spacing the strips of tag material laterally from the edges of the webs by the desired final spacing of the tags from the infusion containing pockets.

3. A method as claimed in claim 1, comprising cutting pockets from the sealed webs which are substantially round in shape except along a pre-cut flattened edge of the webs via which the string exits the pockets.

4. A method as claimed in claim 3, comprising cutting tags from the sealed strips of tag material such that their shape mirrors the shape of the infusion containing pockets.

5. A method as claimed in claim 1, comprising forming lengths of string bridging the web and tag material continuously from a single length of string; and cutting the string between adjacent infusion containing pockets at the same time as the step of cutting the infusion containing pockets from the sealed webs.

6. A method as claimed in claim 5, comprising arranging the lengths of string in a succession of predetermined patterns prior to adhering the lengths of string to one web and its associated strip of tag material, by supporting the string on the periphery of a rotating drum which cooperates with one of the travelling webs, winding the string around a plurality of pins on the surface of the drum, and moving the pins reciprocally along the surface of the drum in a direction which is parallel to the axis of the drum as the drum rotates to shape the string patterns.

7. A method as claimed in claim 1, wherein one of the webs has a thermoplastics coating and further comprising lightly adhering the length of string to the surface of said one of the travelling webs which will become an inner surface of the pockets by heating the web using a heated roller adjacent its outer surface to melt the thermoplastics coating of the web.

8. A method as claimed in claim 7, further comprising heating the web substantially simultaneously with bringing the string into contact with the now adhesive inner surface of the web.

9. A method as claimed in claim 7, further comprising heating the web and subsequently bringing the string into contact with the now adhesive inner surface of the web.

10. A method as claimed in claim 1, wherein the travelling webs are in the form of a single sheet of web material and further comprising folding the sheet over to form the infusion containing pockets.

11. An infusion package made by the method of claim 1.

12. A method as claimed in claim 1, wherein the step of dosing an infusible substance further comprises placing the infusible substance on one of the webs.

13. A method as claimed in claim 1, wherein said step of dosing an infusible substance further comprises placing said infusible substance between the webs.

14. An apparatus for manufacturing tagged infusion packages of the type formed from a two-ply web having an infusion containing pocket defined therein and having a length of string joining the tag and package, comprising:

means for providing a pair of continuous travelling webs for forming successive packages, and for providing associated with each web a continuous strip of tag material for forming the tags guided to travel parallel to and at the same speed as the respective webs;

means for adhering a length of string to one web and its associated strip of tag material, whilst the web and strip travel side by side, such that the string bridges the web and tag material;

dosing means for placing a dose of infusible substance at a location adjacent one of the webs;

sealing means for sealing the webs and strips of tag material together to form a two-ply web having pockets containing the infusible substance and a two-ply tag strip travelling to one side of the two-ply web, the string extending between the web and tag strip at spaced locations; and cutting means for cutting the pockets and tags from the sealed webs and strips of tag material to form tagged infusion packages.

15. An apparatus as claimed in claim 14, wherein the strips of tag material are spaced laterally from the edges of the webs by the desired final spacing of the tags from the infusion containing pockets.

16. An apparatus as claimed in claim 14, wherein the cutting means is arranged to cut pockets from the sealed webs which are substantially round in shape except along a pre-cut flattened edge of the webs via which the string exits the pockets.

17. An apparatus as claimed in claim 16, wherein the cutting means is arranged to cut the tags in such a manner that their shape mirrors the shape of the infusion containing pockets.

18. An apparatus as claimed in claim 14, wherein the sealing means is relieved at the position where the string exits the sealed webs to provide an unsealed groove for the string in the sealed together portion of the webs.

19. An apparatus as claimed in claim 14, wherein said means for adhering a length of string to one web and its associated strip of tag material comprises means for adhering lengths of spring formed continuously from a single length of string to one web and its associated strip of tag material, and wherein the cutting means is arranged to cut the string between adjacent infusion containing pockets at the same time as the infusion containing pockets are cut from the sealed webs.

20. An apparatus as claimed in claim 19, further comprising means for arranging the lengths of string in a succession of predetermined patterns comprising a drum rotatable to cooperate with said one web and having a plurality of pins on its surface reciprocally movable in a direction which is parallel to the axis of rotation of the drum for engaging the string and shaping the string into the successive patterns.

21. An apparatus as claimed in claim 14, wherein one web has a thermoplastics coating and said means for adhering a length of string to one web and its associated strip of tag material includes a heating means located adjacent the outer surface of said one web for melting the thermoplastics coating of said web.

22. An apparatus as claimed in claim 21, wherein said heating means further comprises means for melting the thermoplastics coating substantially simultaneously with bringing the now adhesive inner surface of the web into contact with the string.

23. An apparatus as claimed in claim 21, wherein said heating means further comprises means for melting the thermoplastics coating and subsequently bringing the now adhesive inner surface of the web into contact with the string.

24. An apparatus as claimed in claim 14, wherein the travelling webs are in the form of a single sheet of web material which is folded over to form the infusion containing pockets.

25. An apparatus as claimed in claim 14, wherein said dosing means further comprises means for placing a dose of infusible substance on one of the webs.

26. An apparatus as claimed in claim 14, wherein said dosing means further comprises means for placing a dose of infusible substance between the webs.

* * * * *